US005743383A

United States Patent [19]

Yano et al.

[11] Patent Number: 5,743,383

[45] Date of Patent: Apr. 28, 1998

[54] PUSH BUTTON SWITCH

[75] Inventors: Tadashi Yano, Hirakata; Takefumi Inoue, Katano, both of Japan

[73] Assignee: Matsushita Electric Industrial Co., Ltd., Osaka, Japan

[21] Appl. No.: 681,419

[22] Filed: Jul. 23, 1996

[30] Foreign Application Priority Data

Jul. 25, 1995 [JP] Japan ..... 7-188883

[51] Int. Cl.[6] ..... H01H 3/12

[52] U.S. Cl. ..... 200/344

[58] Field of Search ..... 200/344, 517

[56] References Cited

U.S. PATENT DOCUMENTS 5,389,755 2/1995 Chen ..... 200/517 X
5,457,297 10/1995 Chen ..... 200/344
5,504,283 4/1996 Kako et al. ..... 200/344 X
5,555,971 9/1996 Takada ..... 200/344 X

*Primary Examiner*—Renee S. Luebke
*Attorney, Agent, or Firm*—McDermott, Will & Emery

[57] ABSTRACT

A push button switch has a structure in which a stem 15*a* of a key top 15 directly pushes a cup-shaped rubber 13, and a bulge 13*b* pushes a membrane switch 12*a*, and a first link member 16 in U form having a coupling portion 16*e* having a circular hole in the middle, and a second link member 17 are engaged with each other in an X-form to compose a link mechanism. Since the key top 15 directly pushes the cup-shaped rubber 13, if reduced in thickness, the motion stroke of the cup-shaped rubber 13 can be sufficiently maintained, so that the sensation of manipulation is excellent. When assembling the push button switch, the cup-shaped rubber 13 can be positioned and held in place by making use of the circular hole in the coupling portion 16*e*, and hence assembling is extremely easy.

2 Claims, 7 Drawing Sheets

PUSH BUTTON SWITCH

BACKGROUND OF THE INVENTION

The present invention relates to a push button switch used in a keyboard input device of a personal computer or the like.

A general conventional push button switch used in a keyboard input device or the like has a structure allowing a stem provided on a key top to be fitted to a guide provided in a case so that the key top may be movable up and down. In the push button switch having such structure, if desired to reduce the thickness, it is necessary to shorten the length of the fitting portion. In this case, when an end of a key top is pressed, the key top is inclined, which has led to defects such as malfunction and lack of stability of manipulation.

As a push button switch improving these defects, instead of the structure of fitting the stem and guide, a structure of disposing an X-shaped link member between the key top and case is proposed. An example is shown in FIG. 6 and FIG. 7. FIG. 6 is a sectional view of this push button switch, and FIG. 7 is a perspective view of its link member.

In this push button switch, a membrane sheet 2 printing and forming a membrane switch 2*a* thereon is disposed on a baseplate 1 of a stiff material such as metal plate, and a cup-shaped rubber 3 is disposed on the membrane switch 2*a*. In the opening portion of a case 4 of a molded resin, a first link member 6 and a second link member 7 are engaged in an X-form to compose a link mechanism, and a key top 5 of a molded resin is disposed thereon.

Columnar projections 6*b*, 7*b* disposed at one end each of the first link member 6 and second link member 7 are slidably engaged with engaging parts 4*a* of the case 4, and columnar projections 6*a*, 7*a* provided at other ends are rotatably engaged with engaging parts 5*a* of the key top 5. The first link member 6 and second link member 7 are coupled together by inserting columnar bulges 6*c* provided in the middle of the first link member 6 into slots 7*c* provided in the middle of the second link member 7, and the both members are designed to interlock. In the middle of the first link member 6, a pressing rod 6*d* for pressing the cup-shaped rubber 3 is provided. When the key top 5 is lowered, the cup-shaped rubber 3 descends through the pressing rod 6*d*, and the membrane switch 2*a* is put in action.

The push button switch in this structure operates stably if an end of the key top 5 is pressed. However, since the motion point of the cup-shaped rubber 3 is at a position of about half of the length of the first and second link members 6, 7, the motion stroke of the cup-shaped rubber 3 is about half the motion stroke of the key top 5. Therefore, when the motion stroke of the key top 5 is short, malfunction is likely to occur, and it is not suited to thin design of push button switch. Besides, the contact portion of the cup-shaped rubber 3 and pressing rod 6*d* makes an arc movement, and the motion of the cup-shaped rubber 3 is complicated, and it is practically difficult to manufacture the cup-shaped rubber 3 of long life stable in characteristic.

To position the cup-shaped rubber 3 on the membrane switch 2*a*, it is necessary to furnish the case 4 with a fixing member, or to adhere the cup-shaped rubber 3 directly to the membrane sheet 2. When forming a fixing member, however, in a thin type push button switch, the majority of the space in the case 4 is occupied by the fixing member, and it is hard to dispose a rigid link mechanism. In the case of adhesion, the working process for positioning of the cup-shaped rubber 3 or adhesive application is needed, and the assembling process is complicated and the cost is increased.

SUMMARY OF THE INVENTION

It is hence a primary object of the invention to present a push button switch suited to a thin design, easy in assembling, and excellent in sensation of manipulation.

To achieve the object, the invention presents a push button switch comprising a baseplate, a membrane switch disposed on the baseplate, a cup-shaped rubber disposed above the membrane switch and having a bulge for pressing the membrane switch, a case for enclosing the cup-shaped rubber, a key top disposed above the cup-shaped rubber and having a stem for pressing the cup-shaped rubber, and a link mechanism disposed between the case and the key top, being engaged between the two, wherein the link mechanism comprises a first link member composed of a pair of mutually confronting first arms, a first support bar for supporting by coupling each end of the first arms, and a coupling portion for coupling each middle of the first arms and having a middle hole, and a second link member composed of a pair of mutually confronting second arms, and a second support bar for supporting by coupling each end of the second arms, and the first arms and the second arms are engaged with each other in their middle so as to intersect in an X-form, and the hole of the coupling portion is disposed above the cup-shaped rubber.

This push button switch has a structure in which the stem of the key top directly presses the cup-shaped rubber, and therefore the motion strokes of the two are identical. Therefore, if reduced in thickness, malfunction hardly occurs. Besides, since the key top directly presses the cup-shaped rubber, the sensation of manipulation is excellent. When assembling this push button switch, by making use of the hole in the coupling portion, the cup-shaped rubber can be positioned and held in place, so that assembling may be very easy.

DESCRIPTION OF THE PREFERRED EMBODIMENT

Figure 1:
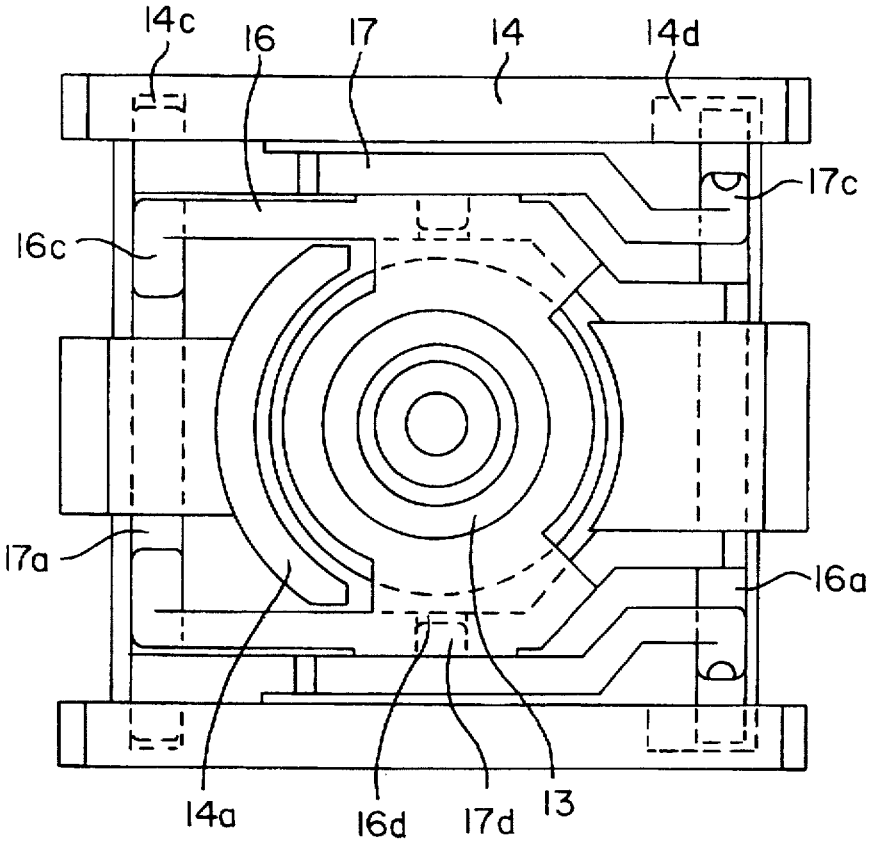
FIG. 1 is a plan view of a push button switch minus key top in an embodiment of the invention.
Figure 2:
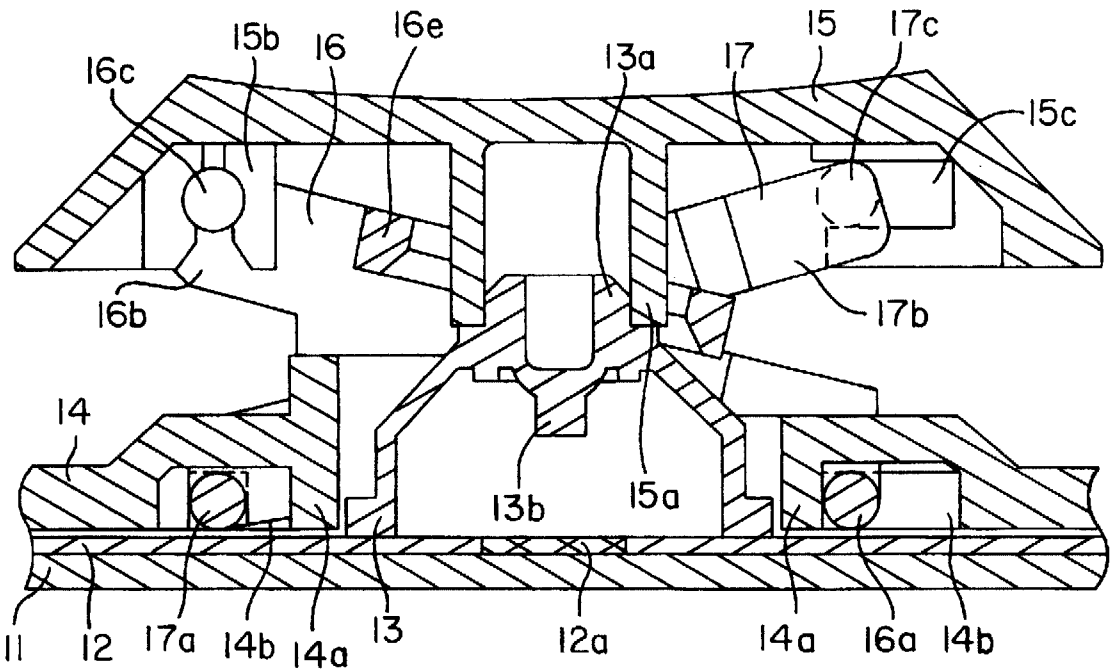
FIG. 2 is a sectional view showing an OFF state of the push button switch in the embodiment.

Referring now to FIG. 1 to FIG. 5, a preferred embodiment of the invention is described below.

On a baseplate 11 of rigid material such as metal plate, a membrane sheet 12, which includes a membrane switch 12*a* is disposed. The membrane sheet 12 is formed by gluing two films of printing conductive paste on a spacer so as to form the membrane switch 12*a*. On the membrane sheet 12, a cup-shaped rubber 13 is provided so that a bulge 13*b* provided at the lower side of the head 13*a* may confront the membrane switch 12*a*, and a molded resin case 14 having a square hole is provided so as to enclose the cup-shaped rubber 13. The cup-shaped rubber 13 has its upper part in an inclined shape. The case 14 has two engaging parts 14*b*, each of which parts has a guide wall 14*a*, and has concave engaging parts 14*c*, 14*d* at the corners of the square hole. A molded resin key top 15 is disposed above the case 14. The key top 15 has a cylindrical stem 15*a* for engaging the head 13*a* of the cup-shaped rubber 13 in the middle of the back side, and concave engaging parts 15*b*, 15*c* on the circumference of the back side.

Between the key top 15 and case 14, a link mechanism composed of molded resin is disposed. The link mechanism comprises a U-shaped first link member 16 and second link member 17. The first link member 16 comprises a pair of arms 16*b* having an engagement hole 16*d* in the middle of each arm, a bar-shaped support shaft 16*a* provided at one end of the arms 16*b*, columnar projections 16*c* provided at the other end, and a coupling portion 16*e* for coupling the arms 16*b* together, said coupling portion having a hole for holding the cup-shaped rubber 13 at the time of assembly. The support shaft 16*a* is slidably engaged and held between the engaging parts 14*b*, 14*d* of the case 14, and membrane sheet 12. The projections 16*c* are engaged with the engaging parts 15*b* of the key top 15.

The second link member 17 comprises a pair of arms 17*b* having columnar projections 17*d* in the middle of each arm for engaging the holes in the arms 16*a*, a bar-shaped support shaft 17*a* provided at one end of the arms 17*b*, and columnar projections 17*c* formed at the other end. The support shaft 17*a* is rotatably engaged and held between the engaging parts 14*b*, 14*c* of the case 14 and the membrane sheet 12. The projections 17*c* are slidably engaged with the engaging parts 15*c* of the key top 15. By inserting the projections 17*d* into the holes 16*d* from outside, the first link member 16 and second link member 17 are engaged with each other, and cooperate in an interlocking manner.

The operation of this push button switch is described below.

When, for example, an upper portion of the engaging part 15*c* of a key top 15 is pressed by the finger tip, the second link member 17 rotates about the support shaft 17*a*, and the projections 17*c* descend while sliding in the engaging parts 15*c*. At the same time, the first link member 16 also rotates in the reverse direction in cooperation with the rotation of the second link member 17. The first link member rotates about the support shaft 16*a*, and the projections 16*c* descend while sliding in the engaging parts 15*b*. In this way, the first link member 16 and second link member 17 move in cooperation, and wherever the key top 15 may be pressed, the key top 15 descends while maintaining a horizontal state.

Figure 3:
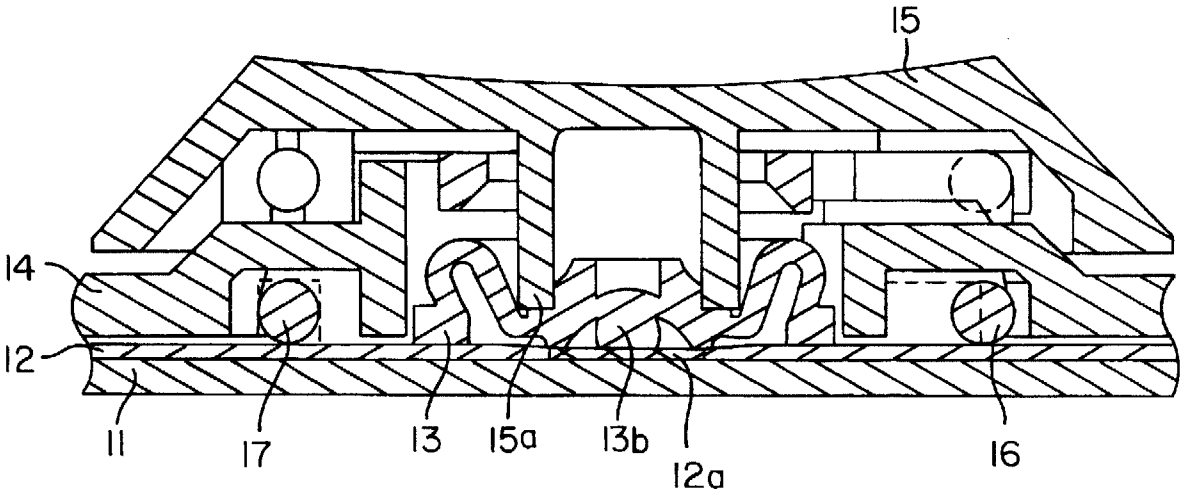
FIG. 3 is a sectional view showing an ON state of the push button switch in the embodiment.

As shown in FIG. 3, when the key top 15 descends, the stem 15*a* presses the head 13*a* of the cup-shaped rubber 13, and the bulge 13*b* pushes the membrane switch 12*a*. When the pushing force is removed, by the restoring force of the elastic cup-shaped rubber 13, the key top 15 ascends and returns to the original position.

This push button switch has the structure in which the stem 15*a* of the key top 15 presses directly the head 13*a* of the cup-shaped rubber 13, and therefore the motion stroke of the cup-shaped rubber 13 is the same as the motion stroke of the key top 15. Therefore, if reduced in thickness, a sufficient motion stroke of the cup-shaped rubber 13 is obtained, and malfunction hardly occurs. The key top 15 descends while maintaining a horizontal state regardless of the pushing position, and hence will not malfunction. Besides, since the key top 15 directly presses the cup-shaped rubber 13, the sensation of manipulation is excellent.

Figure 4:
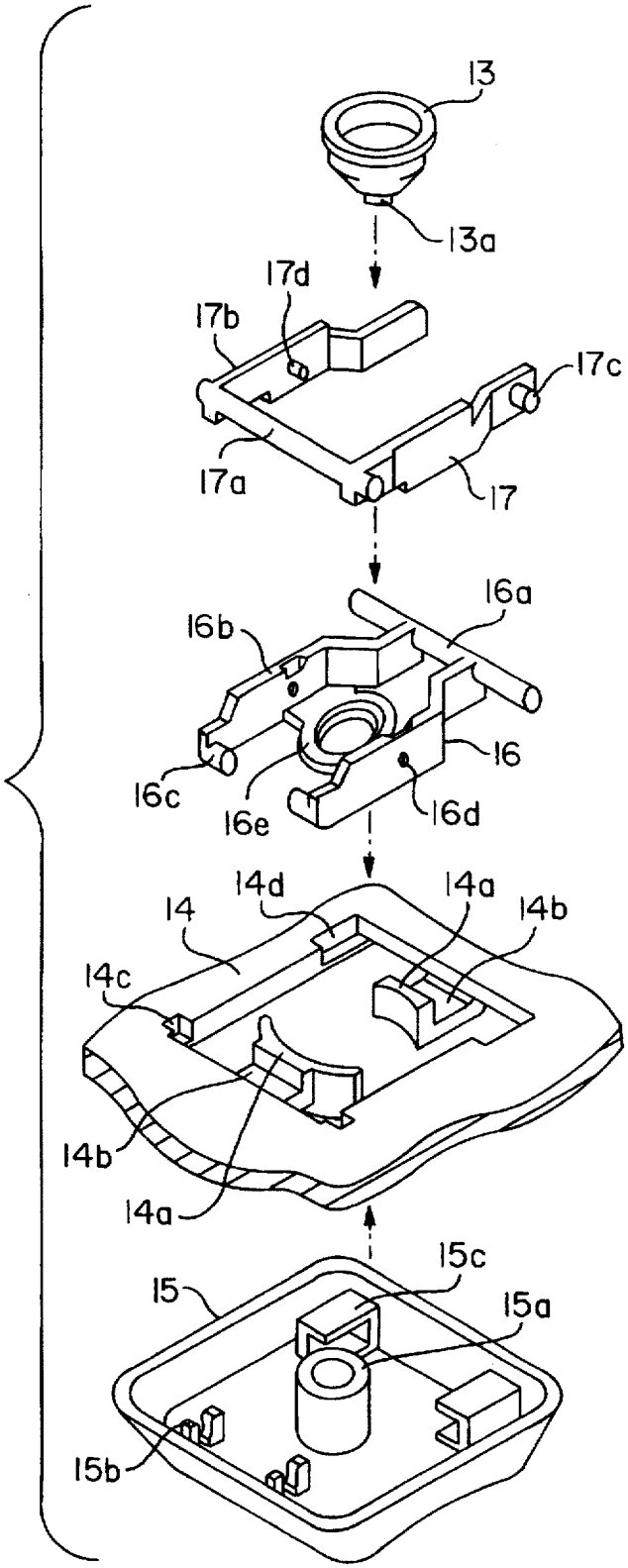
FIG. 4 is a perspective exploded view for explaining the manufacturing process of the push button switch in the embodiment.
Figure 5:
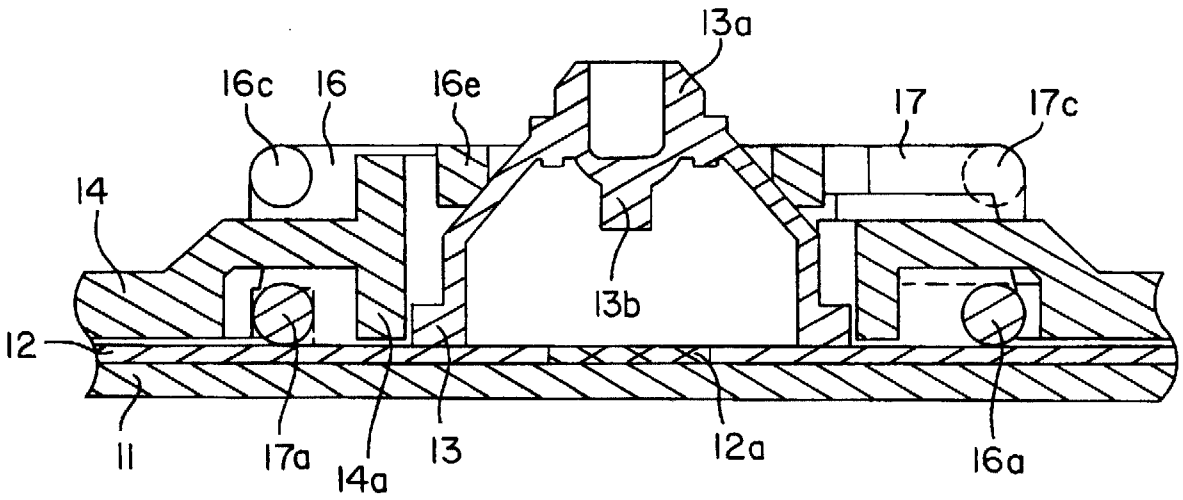
FIG. 5 is a sectional view showing a state before assembling the key top in the push button switch in the embodiment.
Figure 6:
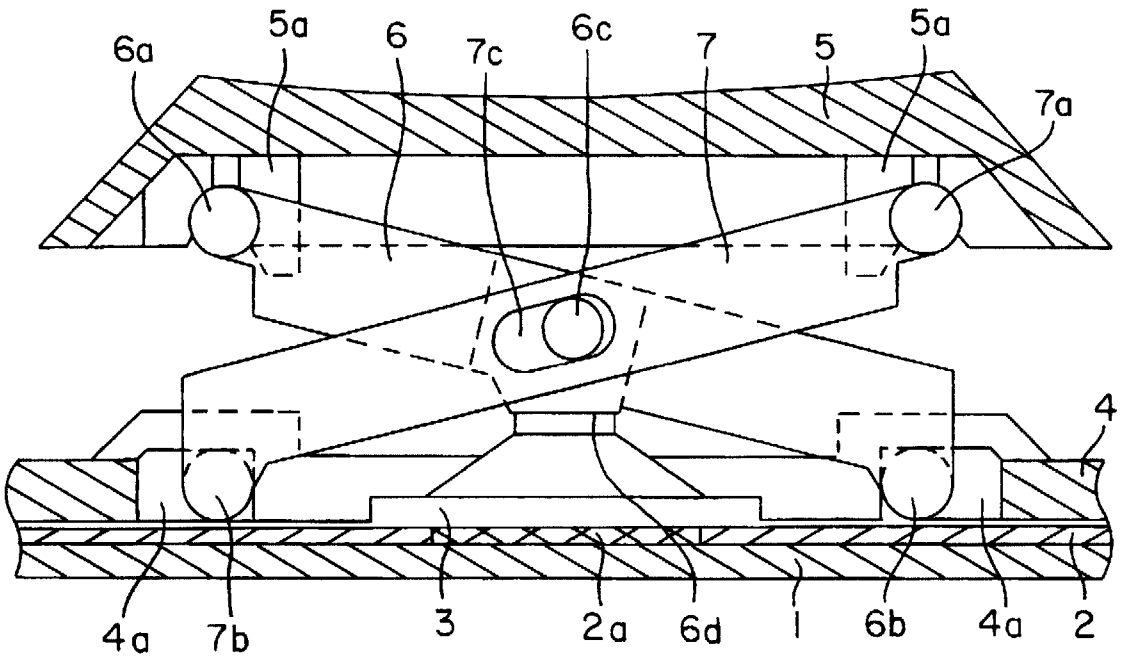
FIG. 6 PRIOR ART
FIG. 6 is a sectional view of a conventional push button switch.
Figure 7:
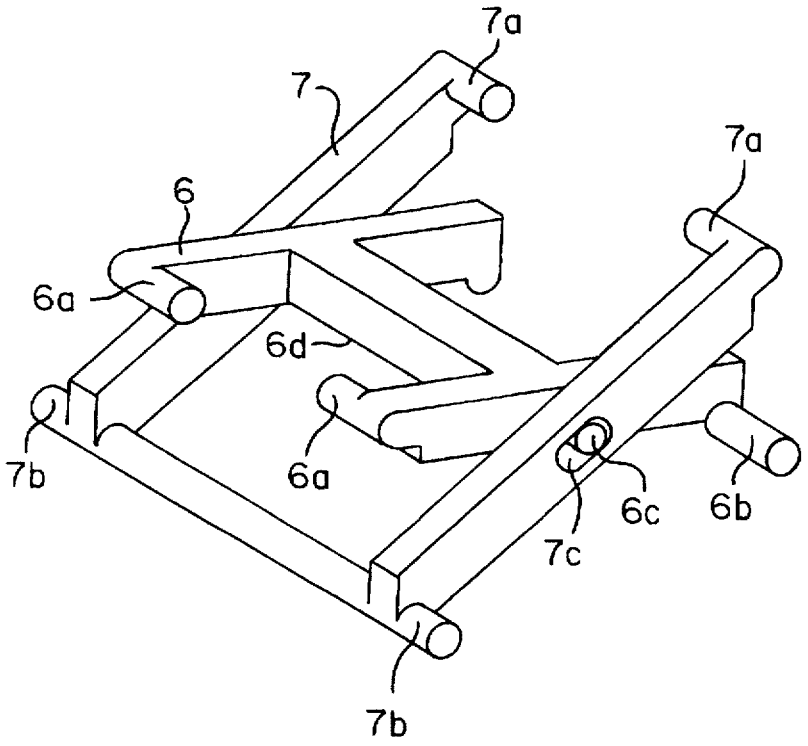
FIG. 7 PRIOR ART
FIG. 7 is a perspective view of a link mechanism used in the conventional push button switch.

The assembling method of this push button switch is described below while referring to FIG. 4 and FIG. 5.

First, by inserting the projections 17*d* into the holes 16*d*, the first link member 16 and second link member 17 are assembled. By inserting the support shafts 16*a*, 17*a* into the engaging parts 14*b*, 14*c*, 14*d*, the both link members 16, 17 are incorporated into the case 14. Next, in order that the head 13*a* may project from the hole of the coupling portion 16*e*, the cup-shaped rubber 13 is inserted between a pair of guide walls 14*a*, and the upper slope of the cup-shaped rubber 13 is put into contact with the hole in the coupling portion 16*e*, thereby positioning the cup-shaped rubber 13. By laminating the membrane sheet 12 and substrate 11, they are fixed to the case 14 with screwing or crimping. Finally, while fitting the projections 16*c*, 17*c* into the engaging parts 15*b*, 15*c*, the key top 15 is snapped in. Incidentally, when assembling the cup-shaped rubber 13 into the link mechanism, the upper slope of the cup-shaped rubber 13 contacts the hole in the coupling portion 16*e*, but after fitting the key top 15, the stem 15*a* pushes the head 13*a*, and hence, the cup-shaped rubber 13 no longer contacts the coupling portion 16*e*. Therefore, the sensation of manipulation is not spoiled when manipulating the key top 15.

In this push button switch, since the cup-shaped rubber 13 is positioned by the contact between the slope of the cup-shaped rubber 13 and the hole in the coupling portion 16*e*, positioning is extremely easy. Besides, in the coupling portion 16*e*, the cup-shaped rubber 13 is held in the hole during the assembling process, and it is not necessary to fix the cup-shaped rubber 13 with adhesive or the like. Thus, this push button switch has a small number of manufacturing steps, it is extremely easy to assemble, and it is also suited to machine assembling. Meanwhile, the inner wall of the hole in the coupling portion 16*e* can be sloped to make the positioning of the upper slope of the cup-shaped rubber 13 in the hole smooth and easy.

Since the coupling portion 16*e* is coupled to the middle of the arm 16*b*, it also plays the role of reinforcement of the strength of the link mechanism. Therefore, when detaching the key top 15 by snap action, the link mechanism will not be broken by the force applied at this time. When detaching the key top 15, incidentally, if the cup-shaped rubber 13 is about to be detached together with the stem 15*a*, the coupling portion 16*e* suppresses it, and hence, the cup-shaped rubber 13 will not be actually detached.

The invention is not limited to the illustrated embodiment alone, but various changes and modifications are possible. For example, in the preferred embodiment, it is shown to position the cup-shaped rubber 13 by contacting the inner wall of the hole of the coupling portion 16*e* with the slope of the upper part of the cup-shaped rubber 13. However, it is also possible to position by the cup-shaped rubber 13 forming plural projections on the inner wall of the hole, and contacting these projections with the slope the cup-shaped rubber 13. Therefore, changes and modifications not departing from the true spirit and scope of the invention should be all included in the scope of the claims.

What is claimed is:

1. A push button switch comprising:

a baseplate;

a membrane switch disposed on the baseplate;

a cup-shaped rubber disposed above the membrane switch and having a bulge for pressing the membrane switch;

a case for enclosing the cup-shaped rubber;

a key top disposed above the cup-shaped rubber and having a stem for pressing the cup-shaped rubber; and a link mechanism disposed between the case and the key top for engaging the case and the key top, wherein the link mechanism comprises, a first link member composed of a pair of mutually confronting first arms, a first support bar for coupling one end of the first arms, and a coupling portion for coupling each middle section of the first arms, the coupling portion having a middle hole, and a second link member composed of a pair of mutually confronting second arms, and a second support bar for coupling one end of the second arms, wherein the first arms and second arms are engaged with each other in their middle sections so as to intersect in an X-form, and the hole of the coupling portion is disposed above the cup-shaped rubber, and wherein an outer diameter of a head of the cup-shaped rubber is smaller than an outer diameter of a bottom thereof, and an inner diameter of the hole of the coupling portion is larger than the outer diameter of the head and smaller than the outer diameter of the bottom.

2. A push button switch of claim 1, wherein a slope is provided in an inner wall of the hole in the coupling portion.

* * * * *